US005197705A

United States Patent [19]

Baskas

[11] Patent Number: 5,197,705

[45] Date of Patent: Mar. 30, 1993

[54] HOLDER FOR BOX DISPENSER

[75] Inventor: Morris J. Baskas, Bronxville, N.Y.

[73] Assignee: Unique Barrier Products Inc., New Rochelle, N.Y.

[21] Appl. No.: 833,959

[22] Filed: Feb. 11, 1992

[51] Int. Cl.[5] ..... A47G 1/10

[52] U.S. Cl. ..... 248/316.7; 248/905

[58] Field of Search ..... 248/905, 313, 316.7, 248/316.2, 231.8, 309.1

[56] References Cited

U.S. PATENT DOCUMENTS

| | | | |
|---|---|---|---|
| 939,937 | 11/1909 | Winans | 248/293 X |
| 2,325,712 | 8/1943 | Shurmur | 248/905 X |
| 2,490,426 | 12/1949 | Gerdeman | 248/905 X |
| 2,784,931 | 3/1957 | Martin | 248/313 |
| 3,733,044 | 5/1973 | Rabber | 248/313 |
| 3,902,932 | 9/1975 | Gdanski et al. | 248/905 X |
| 4,177,910 | 12/1979 | Ganel | 248/905 X |

*Primary Examiner*—Ramon O. Ramirez

[57] ABSTRACT

A holder for a box dispenser of articles for use in a professional office or at home, comprising an L-shaped member having a shelf for receiving the box and an upstanding wall portion on which is mounted a clip. Preferably the clip is spring-biased to hold the box in place. The clip is preferably vertically movable via telescoping members or slots to accommodate different sized boxes.

15 Claims, 4 Drawing Sheets

HOLDER FOR BOX DISPENSER

This invention relates to a holder for a box dispenser, and in particular to a holder adapted for supporting the box dispenser on a wall.

BACKGROUND OF THE INVENTION

Box dispensers are commonly used in professional offices and in homes. For example, in medical and dental offices, they are commonly used to dispense articles such as gloves, film, and towels, In the home, they are commonly used to dispense tissues and bags. The box dispensers are made up of cardboard with an opening at the top for removing articles packed inside the box. For mounting on walls, special plastic containers are provided. Each container is configured to match and hold a particular sized box. This is relatively expensive, and has the disadvantage that a different container is needed for each differently-sized box.

SUMMARY OF THE INVENTION

The object of the invention is a relatively inexpensive box dispenser holder that is capable of being mounted on a wall, and is capable of removably holding a wide variety of box sizes and shapes.

This and other objects and advantages of the invention, as will appear hereinafter, is achieved in accordance with one aspect of the invention, with a novel holder comprising a generally L-shaped member forming a lower shelf portion and an upstanding rear wall portion. The latter is adapted for mounting to a wall. Mounted on the upstanding wall portion is clip means configured to receive and hold a box when placed on the shelf portion.

In a preferred embodiment, the clip means mounting is such as to allow the clip means spacing from the shelf to be varied over a range of at least about one or more inches to accommodate boxes of different sizes. The box containing the articles to be dispensed is seated on the shelf, and the clip means adjusted to bear against the opposite box side to removably clamp the box between the shelf and the clip means. The adjustment of the clip means allows for the holding of boxes in assorted sizes and shapes.

In another preferred embodiment, the clip means is movable from a closed position lying against the upstanding wall portion to an open position for receiving and holding the box dispenser. Preferably, the clip means is spring biased toward its closed position.

In a further preferred embodiment, the clip means engages vertical slots in the upstanding wall portion, and rides up and down the slots to adjust its position relative to the box it is to hold. Preferably, spaced recesses are provided alongside the slots for receiving a protruding tab from the clip means for holding the clip means in a selected vertical position.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described the preferred embodiments of the invention.

DETAILED DESCRIPTION OF THE PREFERRED EMBODIMENTS

Figure 1:
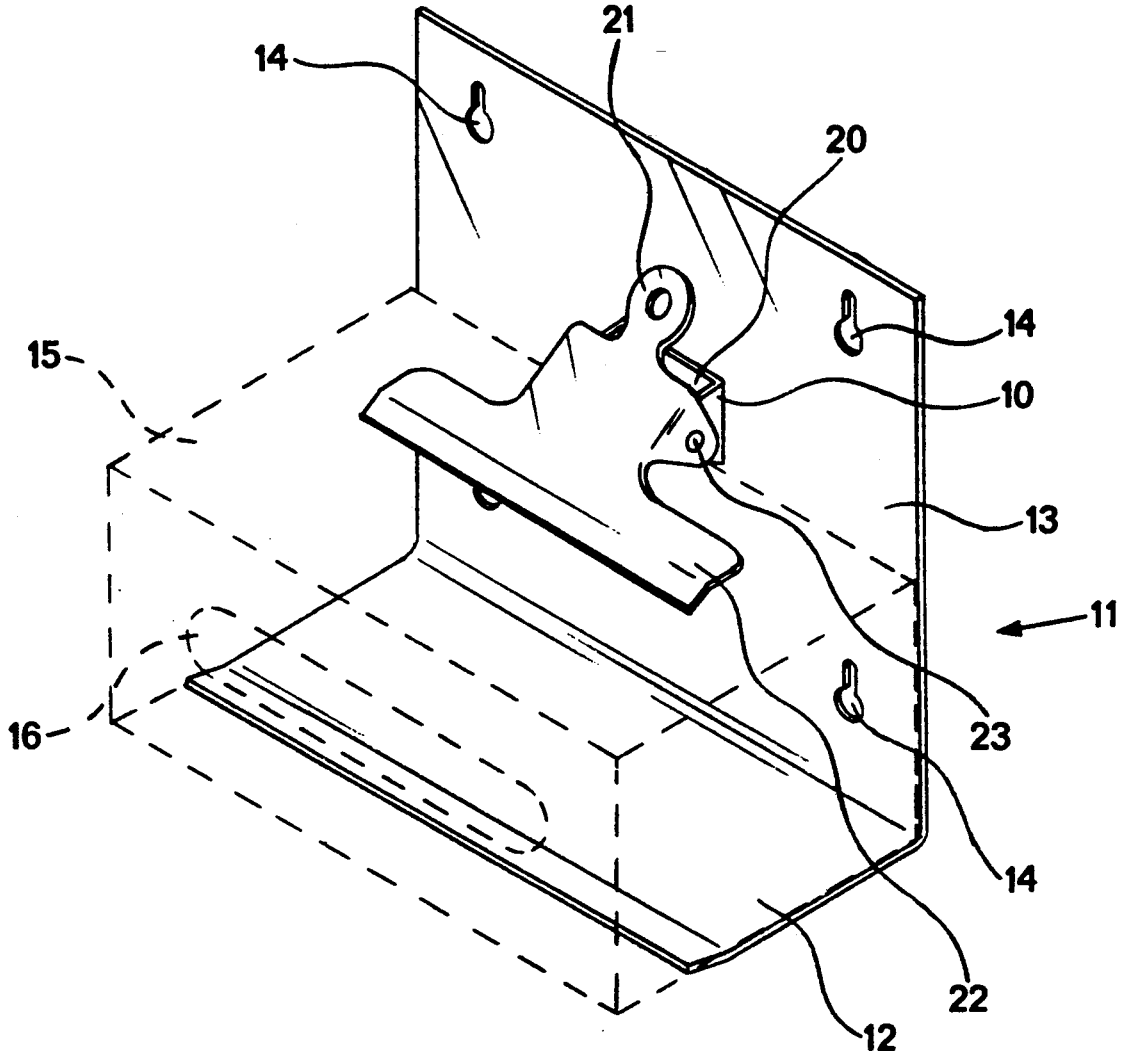
FIG. 1 is a perspective view of a first embodiment of the box dispenser holder in accordance with the invention, with the box shown in phantom.

The embodiment of the invention shown in FIG. 1 uses a fixed clip 10. The holder 11 comprises a generally L-shaped member having a lower shelf portion 12 and a rear upstanding wall portion 13 provided with holder 14 for mounting by means of screws to a wall surface. The shelf 13 has a front edge 14 which is slightly angled upward to help grip a box dispenser 15 shown in phantom. The dispenser 15 typically has a front opening 16 through which the articles to be dispensed can be pulled, one by one, from the box.

The clip 10 is of the type used on clipboards to hold in place papers and other objects. It comprises a mounting portion 20 for fixed mounting to the holder rear portion 13, and a spring-biased (the spring is not shown) clip having a tab portion 21 on top connected to a widened holding portion 22 at the bottom pivoted 23 on the mounting portion 20.

To use on a box of proper size, the user pivots the clip 10 to an open position spaced from the rear holder wall 13, and inserts the box 15 on the shelf underneath the clip 10. The clip 10 is then released, and the spring moves it toward its closed position whereupon the holding portion 22 engages and grips the box, holding it securely in position. The user can then easily remove articles from the box. When the box has been emptied, the user opens the clip 10, discards the empty box, and inserts a new box with a fresh supply of articles.

Figure 2:
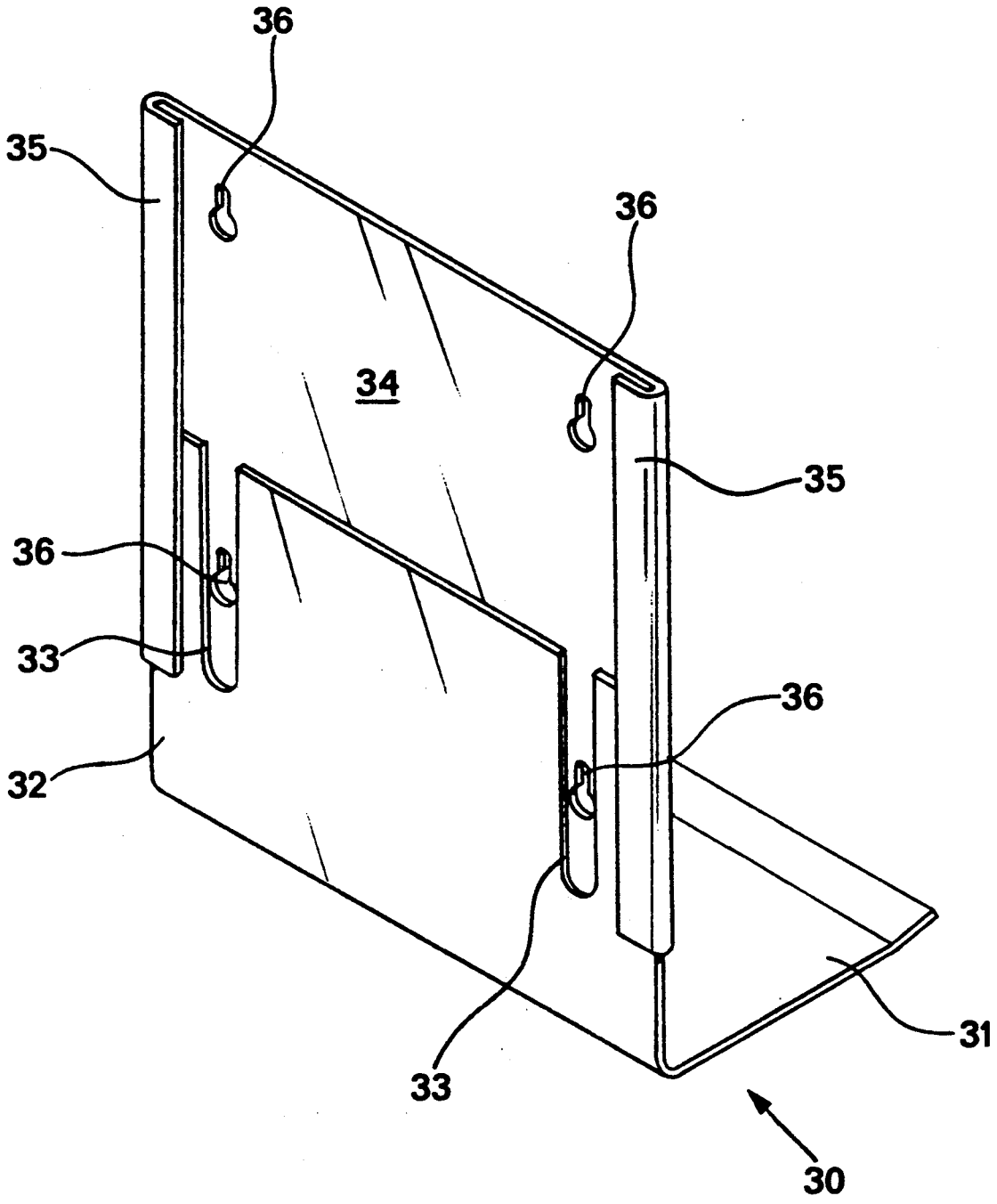
FIG. 2 is a perspective view of the rear of a modification of the box dispenser shown in FIG. 1 with the clip omitted.

In the embodiment shown in FIG. 1, the holder is of one-piece of metal or plastic. FIG. 2 shows a modification which allows for accommodation of boxes of different sizes. In this case, the holder comprises an L-shaped portion having a bottom portion 30 which includes a shelf 31 as before and a shorted rear portion 32 having parallel slots 33, and a second wall portion 34. The latters contains vertical rolled edges 35 which embrace the edges of the rear portion 32. The second wall portion 34 contains the wall mounting openings 36. The bottom two openings 36 are located over the slots 33. A fixed clip 10 (not shown) would be mounted on the second wall portion 34 in front over the shelf 31 as in FIG. 1.

In use, the second wall portion 34 is mounted to the wall, the screws passing through the clearance slots 33. The rolled edges 35 of the second wall portion 34 maintains the telescoping L-shaped portion 30 spaced from the wall so it is free to move up and down within the channel formed by the rolled edges 35. A box is placed upon the shelf 31, the clip opened, and the shelf moved upward to engage the opened clip, which is then released. The spring-biased clip forces the shelf 31 backward. This action cocks or cants the shelf so that its edges engages the inside of the rolled edge channels 35 in a frictional relationship. The frictional forces are sufficient to maintain the shelf 31 in its canted position, and thus locks the box on the holder.

Figure 3:
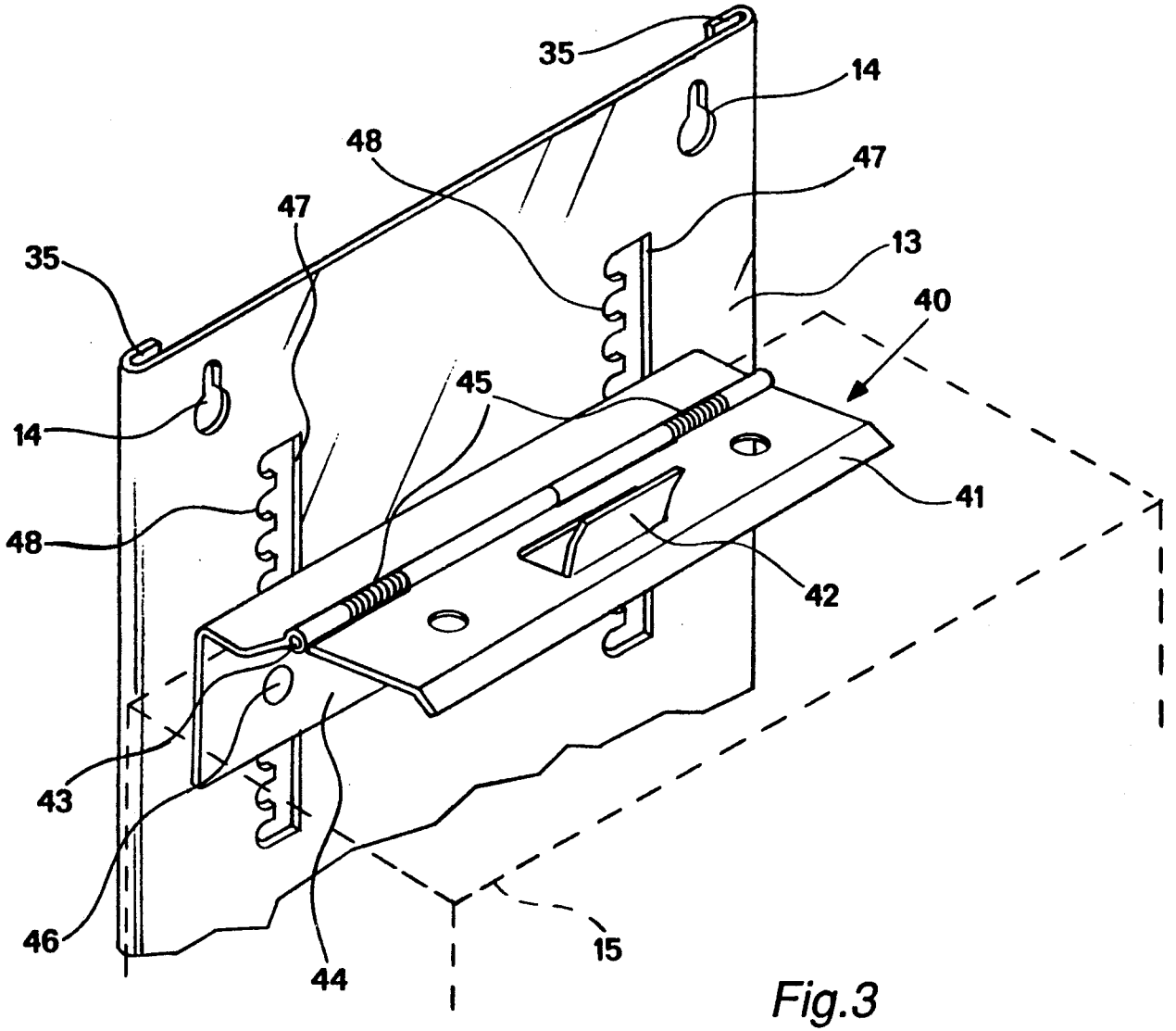
FIG. 3 is a perspective view of another form of clip that can be used in the holder of the invention, with the clip shown in the open position.

In the FIG. 3 embodiment, the L-shaped holder is again made of one-piece, as in FIG. 1, but with the rolled edges 35 at the rear as in FIG. 2. In this case, the clip 40 is vertically movable to accommodate different sized boxes. The clip 40 is shown here in more detail with its holding portion 41 provided with a bent-out tab 42 which serves to open and close the clip 40, here shown in its open position. The holding portion 41 is pivoted 43 on a rear portion 44. Coiled wire spring sections 45 supply the biasing action. The box 15 being held is again shown in phantom.

Figure 4:
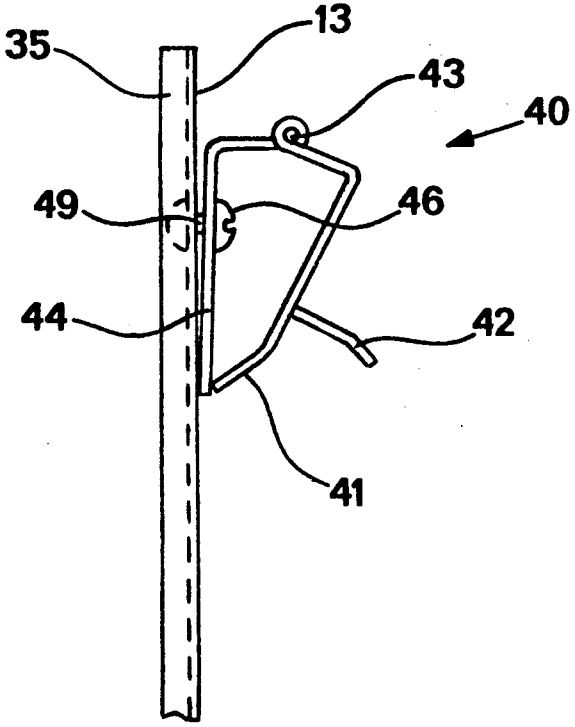
FIG. 4 is a side view of the clip of FIG. 3, this time shown in the closed position.

The mounting of the clip 40 to the holder wall portion 13 is by way of loose rivets 46 which engage parallel slots 47 in the wall portion 13. The slots 47 are each provided with a plurality of vertically oriented spaced edge recesses 48. See also FIG. 4 which shows the clip 40 is in closed position with the box 15 removed. The rivets 46 have widened head portions and a narrow center shank 49 sized to be accommodated in the recesses 48 and to ride up and down in the slots 47. The rivet widened heads overlap the slots and prevent the loosely-held clip 40 from falling out of the slots 47 while allowing the clip 40 to be moved up and down by the user in the slots 47. When the user moves the clip to the left in FIG. 3, the rivet shank 49 engages a recess 48 holding the clip 40 in its vertical position. As in the FIG. 2 embodiment, when the clip 40 as shown in FIG. 3, engages the box 15, the clip 40 is canted backward by the spring pressure holding the clip 40 in the selected recess 48.

Figure 5:
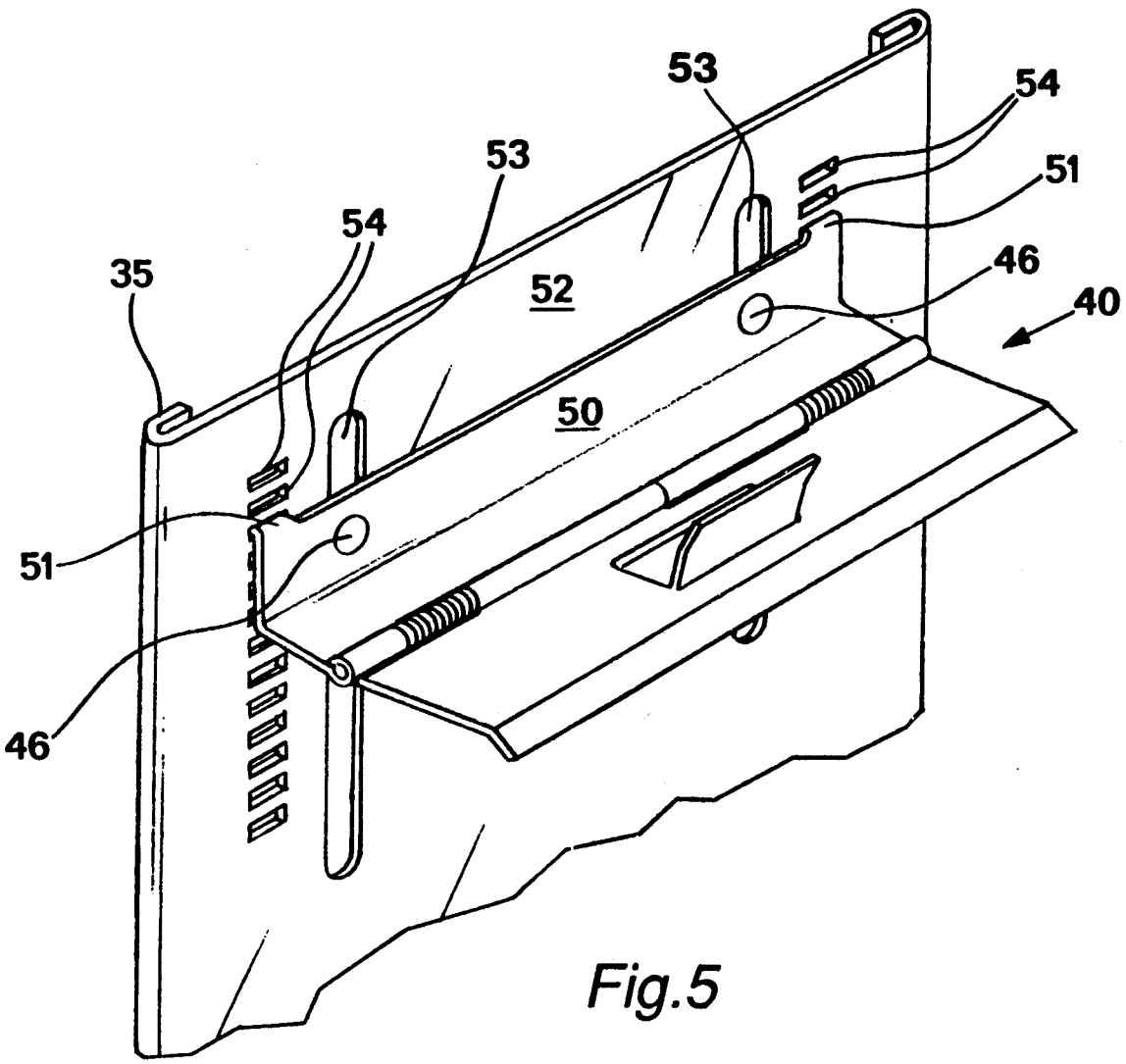
FIG. 5 is a perspective view of another form of clip for use with the holder of the invention.

FIG. 5 shows a preferred embodiment of the movable clip embodiment. The clip 40 is the same as in the FIG. 3 embodiment except it has been provided at its rear portion 50 with short backward protruding tabs 51. The wall mounting rear portion 52, in this case, has straight slots 53 and a series of spaced recesses 54 alongside. The latter are sized to receive the tabs 51 on the clip 40 as shown. As before, rivets 46 loosely hold the clip on the rear wall portion 52 via the slots 53.

Operation is the same as in the FIG. 3 embodiment, except now the clip 40 is tilted downward, which moves the short tabs 51 out the engaged recess 54, the clip 40 can then be positioned upward and downward in the slot 53 to fit the box, and then the clip tilted backwards to cause the tabs 51 to engage the adjacent recesses 54 to lock the vertical position of the clip 40. The spring pressure with the box in place maintains the clip tabs 51 in engagement with the selected recesses 54.

Other variation are possible within the scope of the invention. For example, in the FIG. 3 embodiment, recesses 48 can be provided along opposite edges of the slots 47. Also, the rear hinged section of the clip 40 in the FIG. 3 embodiment has a downward section 44, whereas that in the FIG. 5 embodiment has an upward hinged section 50. These can be reversed.

In the FIG. 5 embodiment, the recesses 54 need not be evenly spaced. More recesses can be provided in the center which corresponds to the sizes of most boxes. Also, while the spring-biased clip is preferred as it provides a greater gripping action on the box, it can be omitted and the box held in place by the weight of the clip pressing downward in its open position.

Another variation in the FIG. 5 embodiment is to add screws to the clip back plate 50 which bear against the upstanding wall portion. The screws are kept loose while the clip 50 is vertically adjustable. When the clip 50 has been placed in the correct position, the screws, threadingly engaging the back plate, are tightened pushing the back plate 50 away from the wall portion 52 to help lock it in position.

In addition, the tabs in FIG. 5 can be provided with an L-shaped end, and the slot 53 and recesses 54 replaced by the slot 47 and recesses 48 of FIG. 3. Then, the L-shaped end of the tab 51 can lock behind the solid wall part adjacent the engaged recess. This variation will allow omission of the rivets 46. If desired, this can be combined with the screws described above.

As another variation of the FIG. 3 embodiment, a center slot can be provided with adjacent recesses in the upstanding wall portion, and an additional screw loosely engaging the clip back plate 44 with an L-shaped end can be provided passing through the center slot. Rotating the screw 90° will lock the L-shaped end behind the wall and the clip to the adjacent recess. Rotating back 90° will release the additional screw from the recess wall adjacent the recess and allow the clip to be moved up and down while the screw extends through the slot.

While the invention has been described in connection with preferred embodiment, further modifications thereof within the principles outlined above will be evident to those skilled in the art and thus the invention is not limited to the preferred embodiments but is intended to encompass all such modifications.

What is claimed is:

1. A holder for a box dispenser comprising:

a generally L-shaped member having a lower shelf portion and an upstanding wall portion, said L-shaped member being one piece and having vertical slots in its upstanding wall portion.

means for mounting the L-shaped member on a wall, clip means located over the shelf portion and having an open position and a closed position, said clip means engaging the slots for movement up and down within the slots.

said clip means in its open position defining with the shelf portion beneath a box receiving region.

2. The holder of claim 1, wherein the upstanding wall portion has a series of recesses spaced from the slots.

3. The holder of claim 1, further comprising spring-biasing means on the clip means for biasing the latter toward its closed position.

4. The holder of claim 3, wherein the upstanding wall portion has edges, further comprising a second wall portion having rolled edges telescoping with the edges of the upstanding wall portion.

5. The holder of claim 4, further comprising means for mounting the second wall portion to a wall.

6. The holder of claim 3, further comprising rivet means holding the clip means on the upstanding wall portion.

7. The holder of claim 1, wherein the vertical slots have vertically-extending edges and the slots have recesses along its edges.

8. The holder of claim 3, wherein the box is held in place by canted clip means when it is in its open position and urged against the box.

9. The holder of claim 2, wherein the clip means has tabs for engaging the recesses.

10. A holder for a box dispenser comprising:

a generally L-shaped member having a lower shelf portion and an upstanding wall portion, said L-shaped member having two horizontally-spaced vertically-extending in its upstanding wall portion, means for mounting the L-shaped member on a wall, clip means located over the shelf portion and having an open position and a closed position, means on the clip means for removably engaging a plurality of vertically-spaced portions of the slots for positioning the clip means to occupy a plurality of positions spaced different vertical distances from the lower shelf portion, said clip means in its open position in each of its plurality of positions defining with the shelf portion beneath a receiving region for receiving and holding different sizes of boxes.

11. The holder of claim 10, further comprising spring-biasing means on the clip means for biasing the latter toward its closed position.

12. The holder of claim 11, wherein the slots each have edges and vertically-spaced recesses along its edges for engagement with the clip means.

13. The holder of claim 11, wherein the upstanding wall portion has a series of recesses spaced horizontally from the slots.

14. The holder of claim 12, wherein the clip means has tabs for engaging the recesses.

15. A holder for a box dispenser comprising:

a generally L-shaped member having a movable lower shelf portion and a fixed upstanding wall portion, means for fixing the upstanding wall portion to a supporting wall, clip means located over the shelf portion and having an open position and a closed position, said clip means in its open position defining with the shelf portion beneath a box receiving region, said clip means being mounted on the fixed upstanding wall portion, spring-biasing means on the clip means for biasing the latter toward its closed position, means for mounting the shelf portion to the fixed upstanding wall portion such that the shelf portion is vertically movable with respect to the clip means for accommodating boxes of different sizes.

* * * * *